United States Patent [19]

Crooks

[11] 4,182,086

[45] Jan. 8, 1980

[54] BUILDING CONSTRUCTION OF A-SHAPED ELEMENTS

[76] Inventor: Melvin Crooks, 1201 W. Church St., Champaign, Ill. 61820

[21] Appl. No.: 903,816

[22] Filed: May 8, 1978

[51] Int. Cl.[2] ..... E04B 1/32

[52] U.S. Cl. ..... 52/81; 52/309.4

[58] Field of Search ..... 52/81, 80, DIG. 10, 52/309.8

[56] References Cited

U.S. PATENT DOCUMENTS

| | | | |
|---|---|---|---|
| 2,928,360 | 3/1960 | Heine, Jr. | 52/80 |
| 4,026,313 | 5/1977 | Zeigler | 52/81 X |
| 4,068,422 | 1/1978 | Sumner | 52/80 |
| 4,146,997 | 4/1979 | Diethorn | 52/81 |

FOREIGN PATENT DOCUMENTS

| | | | |
|---|---|---|---|
| 772048 | 10/1934 | France | 52/81 |

OTHER PUBLICATIONS

*Domebook*, Published by Pacific Domes, 1971, p. 95.

*Primary Examiner*—Carl D. Friedman

[57] ABSTRACT

A building framework includes a group of A-shaped basic building elements interconnected together to form the framework for a building such as a dome, swimming pool cover and a silo. Each one of the A-shaped basic building elements is composed of bendable material to enable it to flex and thus to enable the framework to assume different desired shapes. The building elements include first, second and third elongated strips, which are connected together to form an A shape defining a triangularly-shaped, centrally-disposed opening. The end portions of the strips form first, second and third pairs of legs extending from the centrally disposed opening. The legs are adapted to be connected to the legs of other similar basic building elements. The first and second strips are connected together and mutually intersect at the first pair of legs, and the opposite ends of the first and second strips are each connected to and intersect with the third strip in a spaced-apart manner at the second and third pairs of legs to form the triangularly-shaped opening.

14 Claims, 13 Drawing Figures

FIG. 1
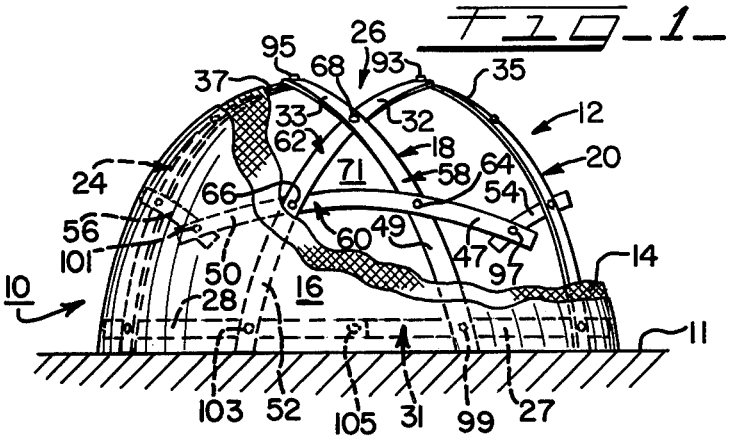
FIG. 3
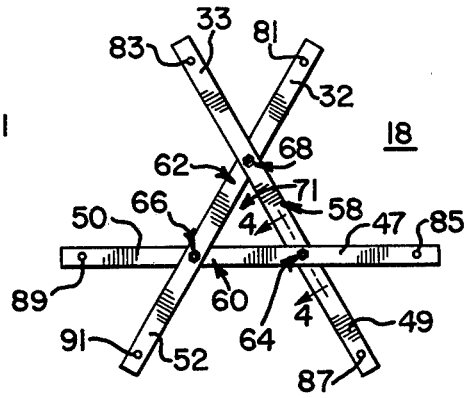
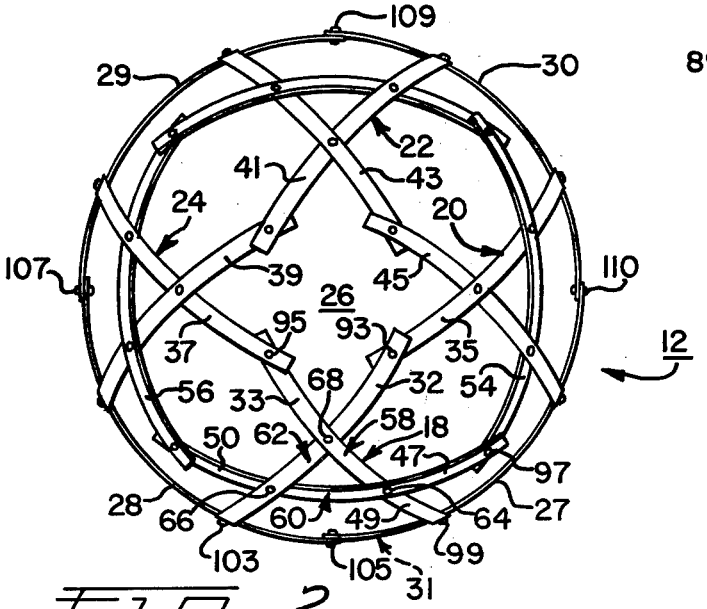
FIG. 2
FIG. 4
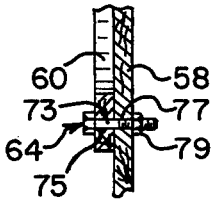
FIG. 5
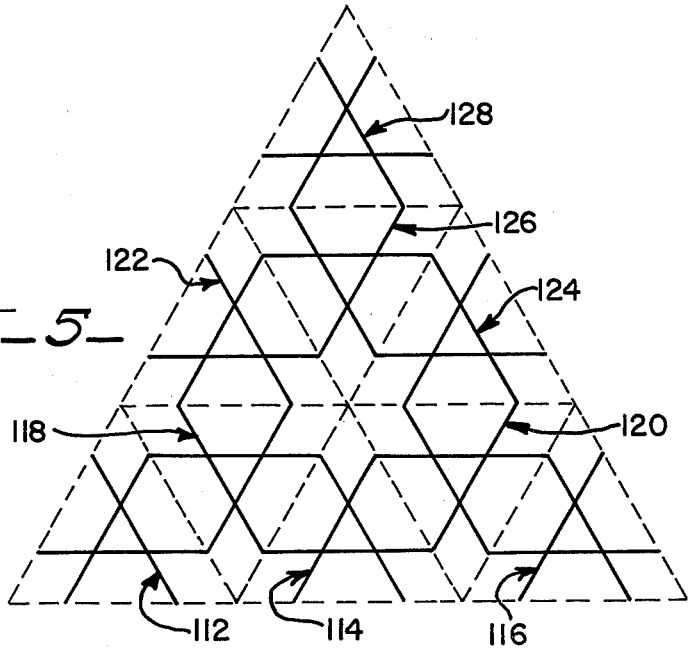

131
133
135
137
139
141
143
145
147
149
152
154
156
158
160
162
164
166
168
170
172
174
176
178
183
185
187
189
191
193
195
197
199
202
204
206
208
209
210
212
214
216
218
221
223
225
227
229
231
235
237
239
240
242
244
246
248
250
252
254
256
258
261
263
265
266
267
268
269
271
273
275
277

BUILDING CONSTRUCTION OF A-SHAPED ELEMENTS

The present invention relates in general to a building framework, and it more particularly relates to a building framework which includes a group of basic building elements connected together to enable the building framework to assume various different desired shapes.

Building frameworks having triangularly-shaped openings to form a geodesic dome having been employed successfully and are now well known. The geodesic dome was disclosed in U.S. Pat. No. 2,682,235, and as disclosed therein, includes a group of strut or spoke elements connected together at their ends by a group of hubs to form an open framework. While the well-known geodesic dome is satisfactory for some applications, it would be well to avoid the use of hubs at the intersections of the strut elements forming the open framework for the geodesic dome, since such a construction of hubs and strut elements must be precisely made and assembled so that the strut elements are positioned at certain critical angles relative to their hubs. Such hubs are relatively expensive to manufacture, and it is desirable to employ skilled personnel to erect such a framework. Accordingly, different types and kinds of prior known building frameworks eliminate the need for hubs. For example, reference may be made to the following U.S. Pat. Nos. 2,167,048; 2,682,235; 2,908,236; 2,978,074; 3,581,451; and 3,863,659. Also, reference may be made to the dome framework constructed of bamboo in a book entitled "DOMEBOOK", published by Pacific Domes, Box 279, Bolinas, California, 1971.

Therefore, it would be highly desirable to have a building framework which would be relatively inexpensive to manufacture and which could be used to form the framework for a dome without the use of conventional geodesic dome hubs. Additionally, the basic framework construction should be relatively inexpensive to manufacture and should be readily adaptable to form various different shapes of building frameworks, such as domes, swimming pool covers, silos and other frameworks characterized by their unique shapes as well, including ornamental structures and toys.

Therefore, the principal object of the present invention is to provide a new and improved building framework, which does not employ geodesic hubs and which can be used for the construction of domes and many other types and kinds of building constructions.

Another object of the present invention is to provide a new and improved building construction, which is relatively inexpensive to manufacture, and which can be assembled by inexperienced personnel.

The above and further objects of the present invention are realized by providing a building framework employing a group of interconnected A-shaped basic building elements or units. The basic A-shaped building element is composed of bendable material to enable it to flex so that the framework can assume various different shapes, such as domes, swimming pool covers, silos and other unique shapes. The basic building element includes first, second and third elongated strips, and the strips are connected together to form an A shape defining a triangularly-shaped, centrally disposed opening. The end portions of the strips form first, second and third pairs of legs extending from the centrally disposed opening. The legs are adapted to be connected to the legs of other similar basic building elements. The first and second strips are connected together and mutually intersect at the first pair of legs, and the opposite ends of the first and second strips are connected to and intersect with, in a spaced-apart manner, the third strip at the second and third pairs of legs to form the triangularly-shaped opening.

The above and other objects, features and advantages of the present invention will become apparent to those skilled in the art from the following detailed description taken in conjunction with the accompanying sheets of drawings, wherein:

FIG. 1 is a fragmentary elevational view of a building construction which is made in accordance with the present invention and which has portions thereof broken away for illustration purposes;

FIG. 2 is a plan view of the building framework of the building of FIG. 1 with the outer covering removed;

FIG. 3 is an elevational view of a basic building element of the framework of FIG. 1;

FIG. 4 is a cross-sectional view of a portion of the basic building element of FIG. 3 taken substantially long the line 4—4 thereof;

FIG. 5 is a diagrammatic view of a series of basic building elements of FIG. 3 interconnected in a manner according to the present invention;

Figures 6, 7, 8, 9:
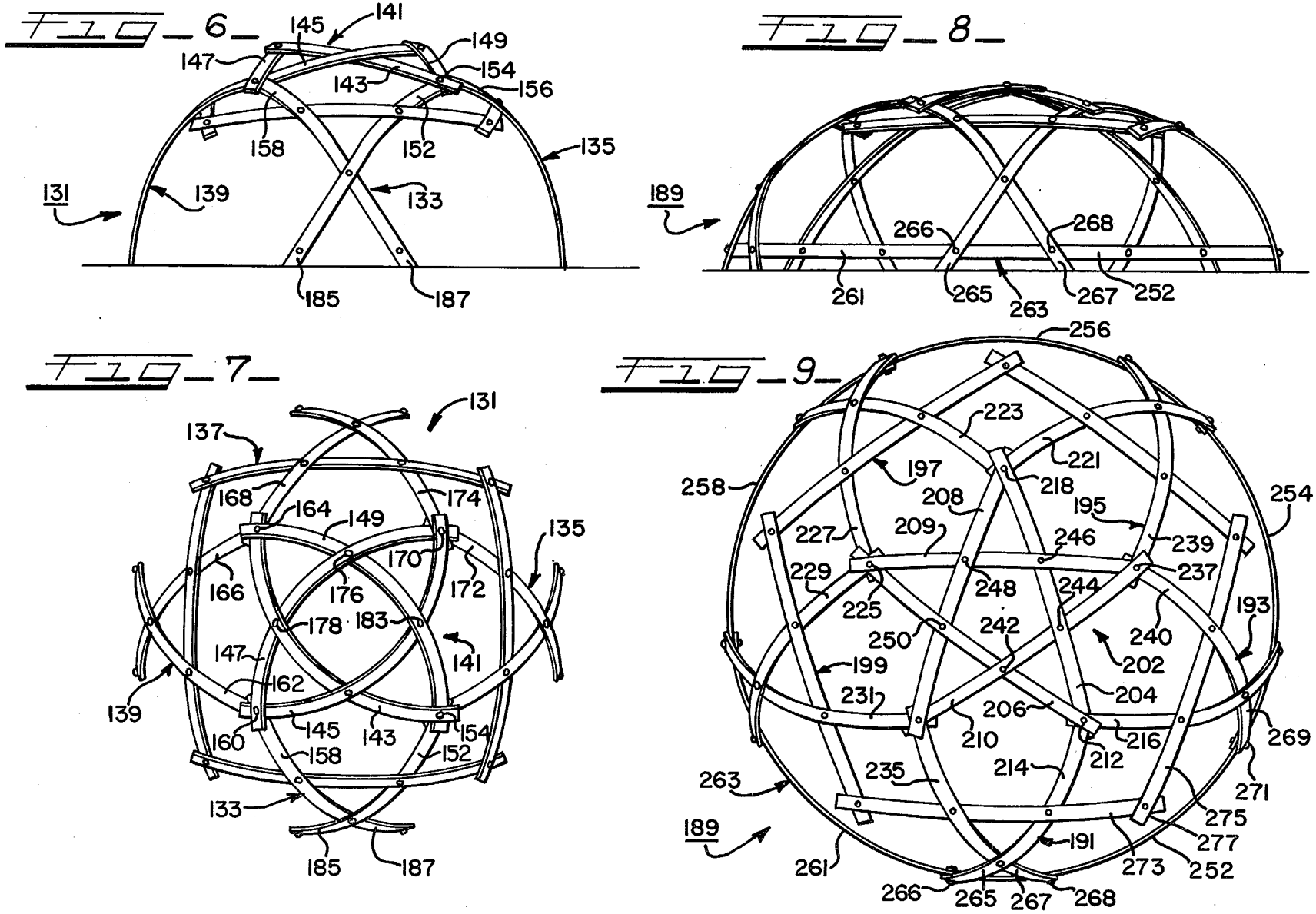
FIG. 6 is an elevational view of another building framework which is also constructed in accordance with the present invention.
FIG. 7 is a plan view of the building framework of FIG. 6.
FIG. 8 is an elevational view of still another building framework which is also constructed in accordance with the present invention.
FIG. 9 is a plan view of the building framework of FIG. 8.

Referring now to the drawings, and more particularly to FIGS. 1, 2, 3 and 4 of the drawings, there is shown a generally dome-shaped building 10 supported on the ground 11, the building 10 being constructed in accordance with the present invention. The building 10 may have doors (not shown) and windows (not shown), and it has an entirely hollow interior. The building 10 may be anchored to the ground 11 by any suitable technique.

The building 10 generally comprises an open framework 12 having a nylon mesh sheet 14 disposed on the outside thereof for supporting a plastic foam outer coating 16 which may be sprayed thereon. The building framework 12 generally includes a series of four A-shaped basic building elements 18, 20, 22 and 24 arranged to form a generally horizontally disposed four-pointed star-shaped opening generally indicated at 26 at the uppermost portion thereof. The four A-shaped building elements are arranged in an upright manner interconnected in a closed loop to form the framework 12 and flexed inwardly to assume a substantially smooth contour to provide the building 10 with a dome shape.

A series of four horizontally-disposed bottom strips 27, 28, 29 and 30 are connected to the four basic building elements and are connected end-to-end to form a bottom reinforcing band or ring 31 to complete the framework 12 and to provide it with greater structural stability.

As will hereinafter become apparent to those skilled in the art, different sizes and shapes of buildings may be provided by employing various different arrangements and combinations of the basic A-shaped building elements.

Referring now to FIG. 2 of the drawings, the basic A-shaped building element 18 includes a pair of legs 32 and 33 at the upper portion thereof which are bent or flexed inwardly and connected to the respective adjacent A-shaped element 20, which is connected to the leg 32 of the element 18. Similarly, a leg 37 of the A-shaped element 24 is connected to the adjacent leg 33 of the element 18. A leg 39 of the element 24 is connected to the adjacent leg 41 of the basic building element 22. A leg 43 of the basic element 22 is connected to a leg 45 of the basic building element 20 to complete a generally-circular closed loop of interconnected basic building elements and to form the four-pointed star-shaped opening 26.

Referring now to FIG. 3 of the drawings, the basic building element 18 will now be considered in greater detail, it being understood that the other three basic building elements are similar to it. The basic building element 18 includes pairs of legs 47 and 49 extending at one side thereof, for connection to the adjacent basic building element 20 and the bottom strip 27. Spaced from the legs 47 and 49, there is provided a pair of left-hand similar legs 50 and 52 which are adapted to be connected respectively to the basic building element 24 and the strip 28. In this regard, as shown in FIGS. 1 and 2, a left-hand leg 54 of the basic building element 20 is connected to the adjacent right-hand leg 47 of the element 18, and a right-hand leg 56 of the building element 24 is connected to the adjacent left-hand leg 50 of the element 18.

It should be noted that all three pairs of legs are similar to one another, and each pair of legs comprise two legs which extend at an acute angle relative to one another.

The basic A-shaped building element 18 generally comprises three strips 58, 60 and 62 interconnected in an A shape. Each one of the strips is composed of bendable material, such as wood as shown in the drawings, or other suitable materials, such as suitable plastic material, so that the basic A-shaped building element can flex as shown in FIGS. 1 and 2 of the drawings when connected to other similar basic building elements in accordance with the present invention.

The strip 58 intersects with the strip 60 at the pair of right-hand legs 47 and 49 and is connected to the strip 60 by means of a fastening device generally indicated at 64, and the opposite end portions of the strips 60 and 58 are connected similarly in a spaced-apart manner to the strip 62. The opposite end of the strip 60 is connected to and intersects with the strip 62 at the pair of left-hand legs 50 and 52. A fastening device 66 fastens the strip 60 to the strip 62 at their intersection, the legs 50 and 52 extending from the fastening device 66. Similarly, a fastening device 68 fastens together the strips 58 and 62 at their intersection, the upper legs 32 and 33 extending outwardly from the point of intersection at the fastening device 68. It should be noted that one of the end portions of each of the strips is disposed in front of and in overlapping relationship with another one of the strips, and the opposite one of the end portions of each one of the strips is disposed in back of and in overlapping relationship with the remaining one of the strips. In this regard, at the intersection of the strips 58 and 60 at the fastening device 64, the strip 60 is disposed in front of the strip 58. At the point where the other end of the strip 60 intersects with the remaining strip 62 at fastening device 66, the strip 60 is disposed in back of the strip 62. Similarly, the strip 62 is disposed in front of the strip 60 and in back of the strip 58 at the fastening device 68. The strip 62 in turn is disposed in front of the strip 62 and in back of the strip 60. Thus, an interweaving of the strips provides the unit with structural integrity and provides the element with a considerable amount of strength. The three strips intersect to form a centrally-disposed triangular opening generally indicated at 71. Each one of the strips is identical to one another, and thus the strips form an equilateral triangularly shaped opening 72. Also, the points of intersection are equally spaced apart relative to the end portions of the strips.

Referring now to FIG. 4 of the drawings, the fastening device 64 will now be considered in greater detail. In this regard, only the fastening device 64 will now be considered in greater detail because it is to be understood that each one of the connections between the strips, as well as the interconnections between other basic building elements and the bottom strip, are similar to one another. The fastening device 64 includes a bolt 73 which extends through aligned openings 75 in the strip 60 and the opening 77 in the strip 58, a nut 79 being threaded onto the opposite end of the bolt 73 to fasten the strips 58 and 60 together.

Similarly, a pair of holes 81 and 83 are located in the end portions of the respective upper legs 32 and 33, and a pair of holes 85 and 87 are located in the end portions of the spective right-hand legs 47 and 49. In a similar manner, the holes 89 and 91 are located in the end portions of the respective left-hand legs 50 and 52. Thus, as best seen in FIGS. 1 and 2 of the drawings, fastening devices 93 and 95 each similar to the fastening devices 64 are adapted to extend through the holes 81 and 83 in the respective upper legs 32 and 33 to fasten them to the respective legs 35 and 37 each having holes (not shown) aligned with the respective holes 81 and 83. Similarly, fastening devices 97 and 99 extend through the respective holes 85 and 87 of the respective legs 47 and 49 to fasten the basic building element 18 to the adjacent basic building element 20 and the bottom strip 27. In like manner, a pair of fastening devices 101 and 103 similar to the fastening device 64 are adapted to extend through the respective holes 89 and 91 of the legs 50 and 52 to attach the basic building element 18 to the adjacent leg 56 of the element 24 and to the strip 28.

In order to fasten together the four bottom strips, a series of four fastening devices 105, 107, 109 and 110, each similar to the fastening device 64, extend through aligned holes in adjacent ones of the bottom strips to arrange them into a closed loop or ring to form the bottom band 31. For example, the fastening device 105 connects the ends of the adjacent strips 27 and 28 by extending through aligned holes (not shown) therein.

In order to construct the building 10 in accordance with the present invention, the framework 12 is first assembled. In this regard, all of the strips forming the framework, as well as the fastening devices, are delivered to the job site. The framework 12 is then assembled by constructing the basic building element 18, 20, 22, and 24 in the form as shown in FIG. 3 of the drawings by means of the sets of three fastening devices. The basic building elements are then interconnected in a side-by-side arrangement by the fastening devices to form a generally circular closed loop to assume the dome shape as indicated in FIGS. 1 and 2 of the drawings. In this regard, the basic building elements flex inwardly to interconnect adjacent upper right and left legs of adjacent basic elements to cause the building elements to assume the outer contour of the framework 12. The four bottom strips 27, 28, 29 and 30 are then fastened at the lower periphery of the four building elements to form the bottom band 31.

The open framework 12 is then covered with the nylon mesh covering 14. The plastic foam coating 16 is then sprayed on the outer surface of the mesh material 14 to complete the building structure 10.

Referring now to FIG. 4 of the drawings, there is shown a diagrammatic view of a technique for interconnecting the basic A-shaped building elements of the present invention. In this regard, three building elements 112, 114 and 116 are interconnected by means of a pair of inverted basic building elements 118 and 120 interposed therebetween. A pair of A-shaped building elements 122 and 124 are interconnected with and disposed above the respective inverted A-shaped building elements 118 and 120. An inverted A-shaped building elements 126 is interconnected with and disposed between the pair of elements 122 and 124 and is interconnected with an uppermost or apex A-shaped building element 128.

Each one of the basic A-shaped building elements including the inverted elements of the diagram of FIG. 5 are similar to one another and to the basic building element 18 of FIG. 3. They are interconnected in a similar manner as the basic building elements of the framework 12 of FIGS. 1 and 2. As indicated by the broken lines surrounding the building elements of FIG. 5, the overall configuration of the nine building elements is generally an equilateral triangular shape or pyramid of the basic elements. Such an interconnection of the basic building elements of the present invention is structurally strong and stable and is able to flex and bend to enable the resulting building to assume a desired shape. In this regard, as will become apparent to those skilled in the art, the triangular configuration of nine basic elements shown in FIG. 5 of the drawings may be interconnected with other similar groups of nine basic elements to form a dome framework, since the basic building unit of such a dome framework is the equilateral triangle as is well known in the art.

Referring now to FIGS. 6 and 7 of the drawings, there is shown a generally domed-shaped open framework 131, which is also constructed in accordance with the present invention. The framework 131 is adapted to form a building structure, such as the dome shaped building 10 of FIG. 1. The framework 131 is similar to the framework 12 of FIG. 1 in that they employ a series of four basic A-shaped building elements, except that that the basic elements of the framework 131 are positioned in an inverted manner. The framework 131 generally comprises four inverted A-shaped basic building elements 133, 135, 137 and 139, which are similar to the basic building element 18 of FIG. 3, and which are each flexed inwardly and interconnected in a side-by-side manner about the periphery of the framework 131 to form a generally circular closed loop configuration to provide the framework 131 with a dome shape. As best seen in FIG. 7 of the drawings, a latticework generally indicated at 141 interconnects the uppermost portions of the basic building elements to provide the upper surface of the dome-shaped framework 131 and thus to complete the framework 131. The latticework 141 generally comprises four strips 143, 145, 147 and 149, each of which is similar to the strips forming the basic building elements. The latticework strips are interconnected in a similar manner as the strips of the basic element of FIG. 3 to form a four-pointed star shaped configuration at the uppermost surface of the dome-shaped open framework 131. The strips are flexed and woven together to provide structural strength.

An upper right-hand leg 152 of the basic building element 133 is connected at 154 to the end portions of the strips 143 and 149 and to an upper left-hand leg 156 of the adjacent building element 135. An upper left-hand leg 158 of the basic building element 133 is connected at 160 to one of the ends of the strips 145 and 147 as well as an upper right-hand leg 162 of the adjacent basic building element 139. The other ends of the strips 143 and 149 are connected at 164 to an upper left-hand leg 166 of the basic building element 139 and to an upper leg 168 of the adjacent building element 137. Similarly, the opposite ends of the strips 145 and 147 are connected at 170 to an upper leg 172 of the basic building element 135 and to an upper leg 174 of the basic building element 137.

As shown in FIG. 7, the strip 147 of the lattice-work 141 is connected at 176 to the strip 149 and is connected to the strip 143 at 178 to provide an A-shaped configuration of the strips 147, 143, and 149. Similarly, the strip 145 is connected at 181 to the strip 143 and at 183 to the strip 149 to provide an A-shaped configuration of the strips 143, 145 and 149.

It should be noted that, unlike the framework 12 of FIG. 1, the bottom portions of the basic building elements are not connected together by a band, and thus the bottom legs, such as the bottom legs 185 and 187 of the basic building element 133 may be anchored to the ground. It should be understood that the interconnections between the basic building elements and the upper strips, as well as the interconnections of the strips forming the basic building elements themselves are formed in a similar manner as the strips of the framework 12. Moreover, the framework 131 may be covered in a similar manner as the framework 12 of FIG. 1.

Referring now to FIGS. 8 and 9 of the drawings, there is shown an open framework 189, which is also constructed in accordance with the present invention. The framework 189 is generally dome-shaped and is simlar to the framework 131 in that it includes a series of interconnected inverted A-shaped basic building elements. The framework 189 generally comprises five inverted A-shaped basic building elements 191, 193, 195, 197 and 199 interconnected together in a side-by-side manner about the periphery of the framework 189 to form a generally circular closed-looped configuration. Each one of the basic building elements is similar to the basic element 18 of FIG. 3 of the drawings and is flexed inwardly to assume the dome shape of the framework 189. A latticework 202 interconnects the upper portion of the basic building element to form an upper roof structure for the dome-shaped framework 189, and is in the form of a five-pointed star. The upper portion of the framework 189 is larger and generally flatter in configuration than the upper portion of the framework 131.

The latticework 202 generally comprises interwoven and interconnected similar strips 204, 206, 208, 209 and 210, which are composed of simlar material as the strips forming the basic building elements of the network 189, as well as the strips forming the basic building elements of the framework 12 of FIG. 1. Moreover, the strips forming the latticework 202 and the basic building elements of the framework 189 are connected together by fastening devices in a simlar manner as the strips of the framework 12 of FIG. 1.

The strips 204 and 206 of the latticework 202 are connected together at 212 to an upper leg 214 of the basic building element 191 and to an upper leg 216 of the adjacent building element 193. Similarly, the opposite end of the strip 204 is connected at 218 to one of the ends of the strip 208 and to an upper leg 221 of the basic building element 195 as well as an upper leg 223 of the basic building element 197. The opposite end of the strip 206 is connected at 225 to one end of the strip 246 and to an upper leg 227 of the building element 197 as well as an upper leg 229 of the building element 199. The ends of the strips 208 and 210 are connected together at 231 to the upper legs 231 and 235 of the adjacent respective building elements 199 and 191. Similarly, the ends of the strips 209 and 210 are connected together at 237 forming another apex of the star-shaped lattice 202, and they are connected to the upper legs 239 and 240 of the respective adjacent building elements 195 and 193.

The strips forming the latticework 202 are interweaved and interconnected in a similar manner as the latticework 141 of FIG. 7 to form a substantially flat horizontally disposed member. In this regard, the strips 206 and 210 are interconnected at 242, and the strip 210 is also connected at 244 to the strip 204 so that the three strips 204, 206 and 210 form an A-shaped configuration. Similarly, the strips 210 and 209 are connected at 246 and 244 to the strip 204 to form an A-shaped configuration. The strip 209 is connected at 248 to the strip 208 to form an A-shaped configuration of the strips 208, 204 and 206. Similarly, the strip 208 is connected to the strip 206 at 250 so tat the strips 208, 210 and 206 form an A-shaped configuration.

Five bottom strips 252, 254, 258 and 261 are connected together end to end in a closed loop manner to form a bottom band 263 similar to the strips forming the bottom band 31 of the framework 12 of FIG. 1. In this regard, for example, the bottom strip 252 is connected at one of its ends to an end of the adjacent strip 261 and a leg 265 of the basic element 291 at a connection point 266. Additionally, the strip 252 is connected to a leg 267 of the building element 191 at 268. The opposite end of the strip 252 is connected to a lower leg 269 of the adjacent building element 193 at a connection point 271, one end portion of the strip 254 being attached to the strip 252 thereat. It should be noted that the upper strips of the basic elements are generally horizontally disposed and are positioned with their faces disposed upwardly. For example, the strip 273 of the element 191 is connected to another adjacent horizontal strip 275 of the adjacent element 193 to form a generally V-shaped apex 277 which projects radially outwardly from the basic contour of the framework 189. As a result, the framework 189 is provided with an esthetically pleasing set of five radially extending peaks.

Figure 10:
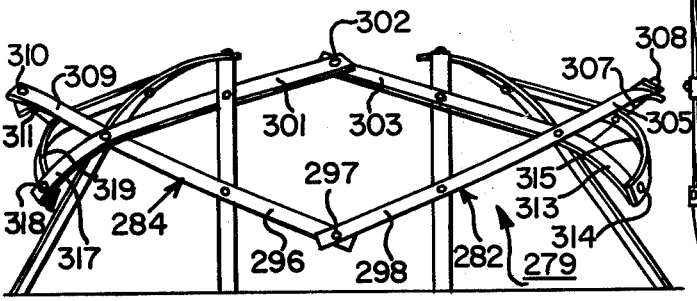
FIG. 10 is an elevational view of yet another building framework, which is also constructed in accordance with the present invention.
Figure 11:
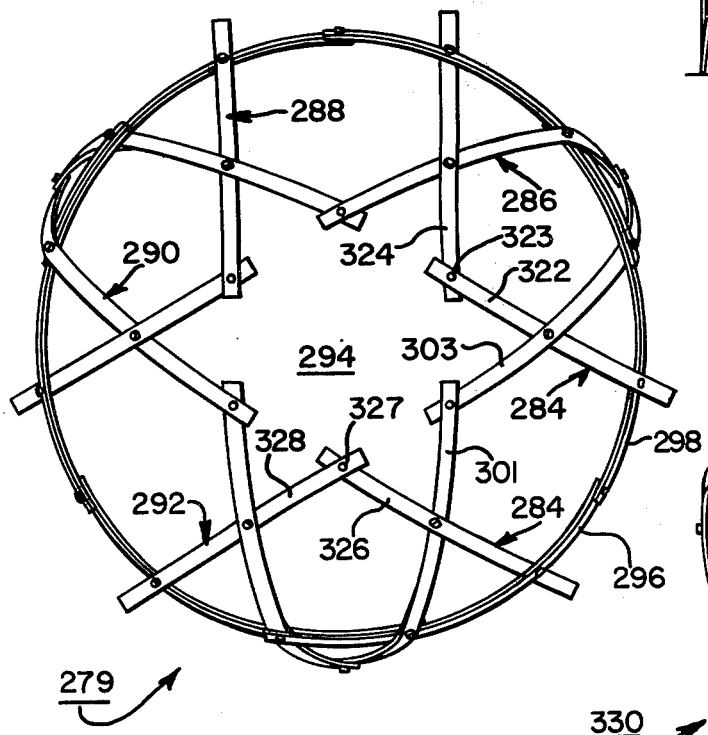
FIG. 11 is a plan view of the building framework of FIG. 10.

Referring now to FIGS. 10 and 11 of the drawings, there is shown a framework 279, which is also constructed in accordance with the present invention. The framework 279 is adapted to provide the shape of a building (not shown) of a unique esthetically pleasing appearance. Such a building could serve as a swimming pool cover.

The framework 279 generally comprises three pairs of inverted A-shaped basic building elements, each of which is similar to the basic building element 18 of FIG. 3 of the drawing. In this regard, the first pair of elements comprise the elements 282 and 284, and similarly the second pair of elements comprise the elements 286 and 288. The third pair comprise the pair of elements 290 and 292. The three pairs of elements are interconnected together in a side-by-side manner about the periphery of the framework 279 and are flexed inwardly and interconnected at their upper portions to form a six-pointed star opening 294. It should be noted that there are no lower bands or strips interconnecting the lower portions of the basic building elements, and thus the lower portions of the basic building elements are adapted to be anchored to the ground.

As clearly shown in FIG. 10 of the drawings, each pair of basic A-shaped building elements are connected together at an angle relative thereto. In this regard, a lower right-hand leg 296 of the element 284 is connected at 297 to a left-hand lower leg 298 of the element 282. An upper right-hand leg 301 of the left-hand element 284 is connected at 302 to a left-hand leg 303 of the right-hand element 282 as viewed in FIG. 10 of the drawings. An inclined upwardly extending right-hand leg 305 of the right-hand element 282 is connected to an upwardly extending left-hand leg 307 of the adjacent element 286 at a connection point 308. Similarly, an upwardly extending left-hand leg 309 of the element 284 is connected at 310 to an upwardly extending right-hand leg 311 of the adjacent element 292. It should be noted that these pairs of upwardly extending legs form attractive peak portions for the framework 279.

A downwardly extending inclined right-hand leg 313 of the right-hand element 282 is connected at 314 to a downwardly extending leg 215 of the element 286. Similarly, a left-hand downwardly extending leg 317 of the element 284 is connected at 318 to an upwardly extending right-hand leg 319 of the element 292.

As best seen in FIG. 11 of the drawings, a right-hand upwardly and inwardly extending leg 322 of the element 284 is connected at 323 to a left-hand upwardly and inwardly extending leg 324 of the element 286 to form a portion of the star-shaped opening 294. Similarly, an upwardly and inwardly extending leg 326 of the element 284 is connected at 327 to an upwardly and inwardly extending right-hand leg 328 of the element 294 to define another portion of the star-shaped opening 294.

Figure 12:
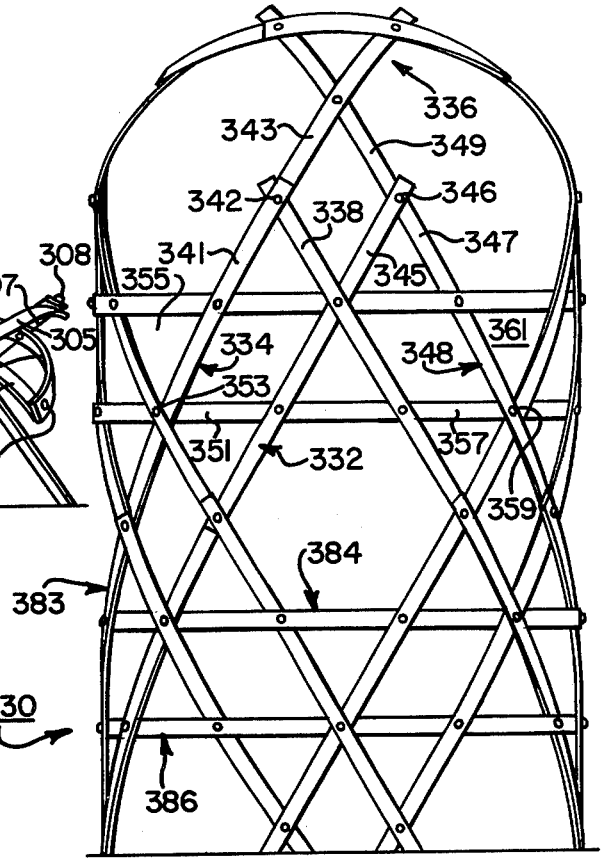
FIG. 12 is an elevational view of a further building framework, which is constructed in accordance with the present invention.
Figure 13:
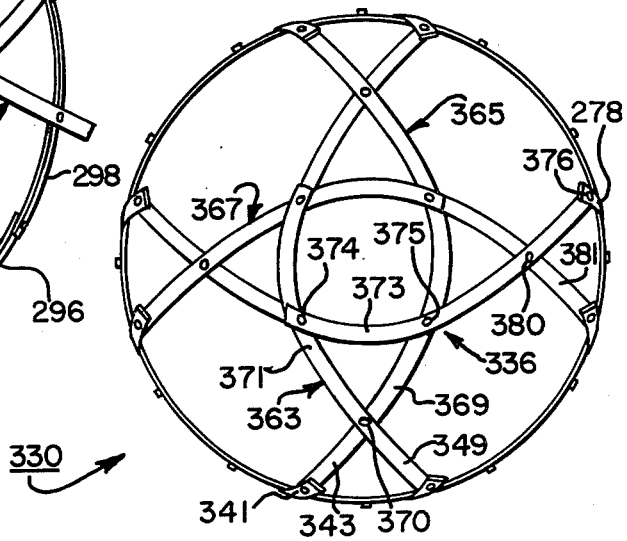
FIG. 13 is a plan view of the building framework of FIG. 12.

Referring now to FIGS. 12 and 13 of the drawings, there is shown an open framework 330, which is constructed in accordance with the present invention, and which is adapted to be used form a building, such as a silo. The framework 330 generally comprises a series of four pairs of A-shaped basic building elements such as the upright element 332 connected to the left-hand inverted element 334 as shown in FIG. 12 of the drawings. A latticework 336 interconnects the upper portions of the generally vertically disposed four pairs of building elements.

In this regard, the upright pairs of building elements are interconnected in a side-by-side vertical manner. For example, the basic building element 332 includes a left-hand upper leg 338 which is connected to the right-hand upper leg 341 at 342, as well as a lower left-hand leg 343 of the latticework 336. Similarly, a right-hand upper leg 345 of the element 332 is connected at 346 to a left-hand leg 345 of an adjacent building element 348, a right-hand leg 349 of the latticework 346 being connected to the legs 345 and 347 at 346 as well. A left side leg 351 is connected at a lower apex 353 of a triangular opening 355 of the inverted building element 334. Similarly, a right-hand side leg 357 of the element 332 is connected at a lower apex 359 of a triangular opening 361 of the inverted element 348.

Considering now the latticework 330 in greater detail, the latticework 330 includes three A-shaped elements generally indicated 363, 365 and 367 to form a four-pointed star shaped configuration. Since each one of the three elements is similar to one another, only the element 363 will now be described in greater detail. The element 363 includes a flexed strip 369 connected at 370 to a flex strip 371, whereby the legs 343 and 349 extend outwardly and downwardly from the connection point 370. A flexed strip 371 extends across the strip 371 and 369 with one end of the strip 373 connected at 374 to the strip 371. The strip 373 is also connected at 375 to the strip 369, and the strip 373 is connected at its opposite end at 376 to a leg 278 of an adjacent upright basic building (not shown). The strip 373 is also connected at 380 between the connections 375 and 376 to a strip 381 of the adjacent element 365.

As shown in FIG. 12 of the drawings, a generally tubular base section 383 is connected to and disposed under the four pairs of alternating inverted and upright elements, such as the element 332 to provide the framework 330 with an elongated configuration. It is to be understood that, in accordance with the present invention, a plurality of axially aligned similar tubular sections (not shown) may be arranged to provide the overall framework with a greater height as desired. The section 383 comprises alternating inverted and upright A-shaped elements, such as the elements 384 and 386 respectively, which are connected together in a manner similar to the alternating elements of the upper section. In this regard, the inverted elements in the lower section are each disposed below the upright elements of the upper section, and the upright elements of the lower section are disposed below the inverted elements of the upper section. For example, it should be noted that the basic building element 384 is disposed directly below the basic building element 332 of the upper section as shown in FIG. 12 of the drawings.

What is claimed is:

1. A building framework, comprising: a group of identical A-shaped basic building elements, each one of said building elements including first, second and third elongated strips of bendable material to enable it to flex so that the framework can assume various different shapes, said strips being connected together to form an A-shape defining a triangularly-shaped, centrally disposed opening and having the end portions of said strips forming first, second and third pairs of legs extending from the centrally disposed opening, said first and second strips being connected together and mutually intersecting at said first pair of legs and being connected and intersecting near their opposite ends in a spaced-apart manner to said third strip at said second and third pairs of legs to form the triangularly-shaped opening, each of said basic building elements being interconnected to a plurality of other building elements adjacent to the ends of the legs thereof.

2. A building framework according to claim 1, wherein said triangularly-shaped opening is in the shape of an equilateral triangle.

3. A building framework according to claim 1, wherein one of the end portions of each one of said strips is disposed in front of and in overlapping relationship with another one of said strips and the opposite one of the end portions of each one of said strips is disposed in back of and in overlapping relationship with the remaining one of said strips.

4. A building framework according to claim 1, wherein each of said first, second, and third strips is provided with four aligned holes, two of the holes being located adjacent to the opposite ends of each strip and the other two holes being disposed therebetween and spaced from adjacent holes by equal distances, said other two holes of each strip being aligned with one of the other two holes of another strip, in combination with a fastening device extending through aligned holes.

5. A building framework according to claim 1, wherein each one of said first, second and third strips includes a hole extending therethrough at each intersection with another strip, the holes of intersecting strips being aligned, in combination with a fastening device extending through aligned holes.

6. A building framework according to claim 1, wherein said group of A-shaped basic building elements includes a series of said basic building elements each disposed in an upright manner and connected in a side-by-side manner with each one having the right-hand side leg of its first pair of legs connected to a left-hand side leg of an adjacent basic element and having the left-hand side leg of its second pair of legs connected to a right-hand side leg of another adjacent basic element.

7. A building framework according to claim 1, wherein said group of A-shaped basic building elements includes a series of said basic building elements each disposed in an inverted manner and connected in a side-by-side arrangement with each one having the right-hand side leg of its first pair of legs connected to a left-hand side leg of an adjacent basic element and having the left-hand side leg of its second pair of legs connected to a right-hand leg of another adjacent basic element.

8. A building framework according to claim 7, wherein each one of said basic elements of said series of said basic elements has the lower right-hand leg of its third pair of legs connected to a lower left-hand leg of said adjacent basic element and having the lower left-hand leg of its third pair of legs connected to a lower right-hand leg of said another adjacent basic element.

9. A building framework according to claim 1, wherein said group of A-shaped basic building elements includes a series of said basic building elements arranged in alternating upright and inverted dispositions and connected in a side-by-side manner, each one of the upright elements having the upper right-hand leg of its first pair of legs connected to the left-hand leg of the first pair of legs of an adjacent inverted basic element and having the right-side leg of its second pair of legs connected to the left-hand lower leg the second pair of legs of said adjacent inverted basic element.

10. A building framework according to claim 9, wherein said series includes a set of five alternating upright and inverted interconnected basic elements arranged with the outer elements being upright elements, said series further including a set of three alternating upright and inverted interconnected basic elements having the outer end upright elements connected to corresponding inverted elements of said set of five elements, said series further including a single upright basic element connected to the inverted basic element of said set of three elements to form a basic triangularly-shaped basic unit adapted to be interconnected with other such basic units.

11. A building framework according to claim 9, wherein said series extends in a closed loop configuration to form a tubular section of the framework, said group further including a second series of alternating upright and inverted ones of said basic building elements interconnected in a manner similar to the first-mentioned series, said second series extending in a closed loop configuration to form a tubular section and interconnected with the first-mentioned section in axial alignment therewith.

12. A building framework according to claim 1, wherein said group of interconnected basic elements extend in a generally circular closed loop configuration, at least some of said basic elements being flexed inwardly to cause the framework to assume a generally a dome shape.

13. A building framework according to claim 1, further including a bottom reinforcing band connected to the lower portions of said basic elements and a latticework connected to the upper portions of said basic elements to complete the top portion of the framework.

14. A building framework according to claim 1, further including a mesh covering positioned over said group of A-shaped building elements and an outer coating disposed on the outer surface of said meshing covering, said coating being composed of foam material.

* * * * *